US007422286B2

(12) United States Patent
Wu

(10) Patent No.: US 7,422,286 B2
(45) Date of Patent: Sep. 9, 2008

(54) CHAIR AND METHOD FOR SUPPORTING LOWER BACK

(76) Inventor: Wenjin Wu, 21E, Li Jing Ge, Bei Xiu Hua Yuan, Little North Road, Guangzhou (CN) 510045

( * ) Notice: Subject to any disclaimer, the term of this patent is extended or adjusted under 35 U.S.C. 154(b) by 0 days.

(21) Appl. No.: 11/563,013

(22) Filed: Nov. 23, 2006

(65) Prior Publication Data

US 2007/0085398 A1 Apr. 19, 2007

Related U.S. Application Data

(63) Continuation-in-part of application No. PCT/CN2005/000973, filed on Jul. 4, 2005.

(30) Foreign Application Priority Data

Jan. 24, 2006 (CN) ..... 2006 1 0033298

(51) Int. Cl.
*A47C 7/42* (2006.01)
*A47C 7/44* (2006.01)
*A47C 3/026* (2006.01)

(52) U.S. Cl. ..... 297/284.5; 297/284.8; 297/383; 297/230.1; 297/230.11; 297/230.13; 297/230.14

(58) Field of Classification Search ..... 297/284.5, 297/284.8, 383, 230.1, 230.11, 230.13, 230.14
See application file for complete search history.

(56) References Cited

U.S. PATENT DOCUMENTS

| | | | | | |
|---|---|---|---|---|---|
| 363,211 | A * | 5/1887 | Cowing | 297/230.11 |
| 1,345,785 | A * | 7/1920 | Koch | 297/230.11 |
| 5,067,187 | A * | 11/1991 | Messina | 297/383 X |
| 5,344,216 | A * | 9/1994 | Suominen | 297/383 |
| 5,507,559 | A * | 4/1996 | Lance | 297/284.5 |
| 5,599,066 | A * | 2/1997 | Chih | 297/383 |
| 7,114,776 | B1 * | 10/2006 | Wiltberger | 297/284.5 |
| 2003/0137172 | A1 * | 7/2003 | Chu | 297/284.5 |
| 2004/0104610 | A1 * | 6/2004 | Jaskot et al. | 297/284.5 |
| 2004/0124680 | A1 * | 7/2004 | Harris | 297/284.5 |
| 2007/0188003 | A1 * | 8/2007 | Wu | 297/284.8 |

* cited by examiner

*Primary Examiner*—Rodney B. White
(74) *Attorney, Agent, or Firm*—Matthias Scholl P.C.; Matthias Scholl

(57) ABSTRACT

Provided is a chair comprising a seat; a backrest; a first armrest; a second armrest; a seat support structure; and a support structure for supporting the lower back of a seated person; wherein the support structure is directly mechanically-connected to the first armrest and the second armrest; and the support structure is not directly mechanically-connected to either the backrest or the seat. Additionally, provided are methods for supporting the lower back of a seated person in the need of such supporting comprising providing to the person a chair as described above.

14 Claims, 3 Drawing Sheets

CHAIR AND METHOD FOR SUPPORTING LOWER BACK

CROSS-REFERENCE TO RELATED APPLICATIONS

This application is a continuation-in-part of International Patent Application No. PCT/CN2005/000973 with an international filing date of Jul. 4, 2005, designating the United States, now pending, and further claims priority benefits to the Chinese Patent Application No. 200610033298.1 filed Jan. 24, 2006. The contents of both of these specifications are incorporated herein by reference.

BACKGROUND OF THE INVENTION

1. Field of the Invention

This invention relates to chairs, accessories for chairs, and to methods for supporting the lower back of a seated person.

2. Description of the Related Art

Conventional chairs do not provide adequate support of the lower back of a person sitting in the front portion of a chair and leaning backwards. In such sitting position, the lower back falls into a void created between the backrest and the seat of the chair, is suspended in the air, and hence unsupported.

To solve this problem, many methods have been devised. One of these methods is to provide a lumbar support cushion separately, or attached to the backrest of the chair at an appropriate height. The lumbar support cushion can be moved up and down along the backrest, but generally cannot be moved horizontally forwards and backwards according to the position of the lower back of a seated person. Moreover, when a person sits up or bends forward slightly, the lower back is unsupported.

Another method is to provide an S-shaped backrest and to utilize the protrusion thereon to support the lower back of a seated person. However, the position of the protrusion is generally fixed and thus cannot be adjusted according to the position of the lower back of the seated person. Therefore, an S-shaped backrest cannot satisfy the requirement for variable sitting positions and variable strengths necessary to support the lower back in different persons. Furthermore, conventional chairs and methods do not provide relief to persons with lumbar pain or soreness.

Accordingly, much opportunity for improvement remains in the area of providing support to the lower back of a seated person.

SUMMARY OF THE INVENTION

In view of the above-described problems, it is one objective of the present invention to provide a chair and a method for supporting the lower back of a seated person, wherein a support element that can serve to support the lower back of a seated person in different sitting postures allows additionally for alleviating of the tiredness of the lower back.

In accordance with one embodiment of the present invention, a chair comprises a seat; a backrest; a first armrest; a second armrest; a seat support structure; and means for supporting the lower back of a seated person; wherein the means for supporting the lower back of a seated person is directly mechanically-connected to the first armrest and the second armrest; the means for supporting the lower back of a seated person is not directly mechanically-connected to either the backrest or the seat; and the means for supporting the lower back of a seated person is a flexible support element being of an elongated shape.

In one class of this embodiment, the support element is a strip, a band or a rope.

In one class of this embodiment, the means for supporting the lower back of a seated person is a flexible support element having two ends, one of the ends being connected to the first armrest and the other end being connected to the second armrest.

In another class of this embodiment, the position of the support element can be changed with respect to the first and/or the second armrest.

In a further class of this embodiment, the means for supporting the lower back of a seated person is capable of supporting the lower back of a seated person in various sitting postures.

In a further class of this embodiment, the flexible support element and the first and the second armrests further comprise means for mechanically-connecting the flexible support element to the first and the second armrests.

In a further class of this embodiment, the means for mechanically-connecting the flexible support element to the first and the second armrests comprises a pair of hooks disposed one at each end of the flexible support element; and a plurality of cavities capable of receiving the hooks disposed in the in first and the second armrests.

In a further class of this embodiment, the first and the second armrests have a longitudinal direction, the plurality of cavities are disposed in the in first and the second armrests at various positions along the longitudinal direction, and the hook is inserted into cavities in the first and the second armrests at various positions along the longitudinal direction so as to provide support to the lower back of the seated person in different sitting postures.

In a further class of this embodiment, the flexible support element is covered with a soft material.

In a further class of this embodiment, the flexible support element is made of leather, a knitted or woven material, or a plastic material.

In another embodiment of this invention, a chair comprises a seat; a backrest; a first armrest; a second armrest; a seat support structure; and means for supporting the lower back of a seated person; wherein said means for supporting the lower back of a seated person is directly mechanically-connected to said first armrest and said second armrest; said means for supporting the lower back of a seated person is not directly mechanically-connected to either said backrest or said seat; and said means for supporting the lower back of a seated person assumes the shape of the lower back of a seated person using said chair.

In other aspects of the present invention, a method for supporting the lower back of a seated person in the need of such supporting comprises providing to the person a chair comprising a seat; a backrest; a first armrest; a second armrest; a seat support structure; and means for supporting the lower back of a seated person; wherein the means for supporting the lower back of a seated person is directly mechanically-connected to the first armrest and the second armrest; the means for supporting the lower back of a seated person is not directly mechanically-connected to either the backrest or the seat; and the means for supporting the lower back of a seated person is a flexible support element being of an elongated shape.

In one class of this embodiment, the support element is a strip, a band or a rope.

In a class of this embodiment, the means for supporting the lower back of a seated person is a flexible support element having two ends, one of the ends being connected to the first armrest and the other end being connected to the second armrest.

In another class of this embodiment, the position of the support element can be changed with respect to the first and/or the second armrest.

In a further class of this embodiment, the means for supporting the lower back of a seated person is capable of supporting the lower back of a seated person in various sitting postures.

In a further class of this embodiment, the flexible support element and the first and the second armrests further comprise means for mechanically-connecting the flexible support element to the first and the second armrests.

In a further class of this embodiment, the means for mechanically-connecting the flexible support element to the first and the second armrests comprises a pair of hooks disposed one at each end of the flexible support element; and a plurality of cavities capable of receiving the hooks disposed in the in first and the second armrests.

In a further class of this embodiment, the first and the second armrests have a longitudinal direction, the plurality of cavities are disposed in the in first and the second armrests at various positions along the longitudinal direction, and the hook is inserted into cavities in the first and the second armrests at various positions along the longitudinal direction so as to provide support to the lower back of the seated person in different sitting postures.

In a further class of this embodiment, the flexible support element is covered with a soft material.

In a further class of this embodiment, the flexible support element is made of leather, a knitted or woven material, or a plastic material.

DETAILED DESCRIPTION OF THE INVENTION

Figure 1:
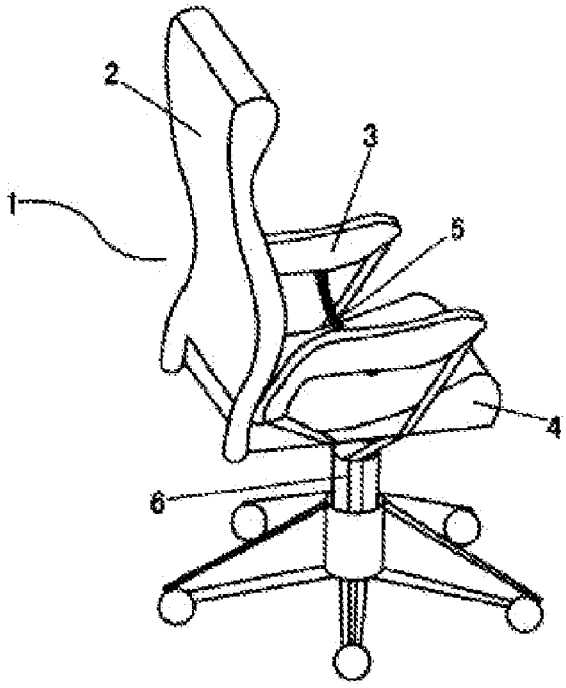
FIG. 1 is a perspective view of a chair in accordance with the present invention.
Figure 2:
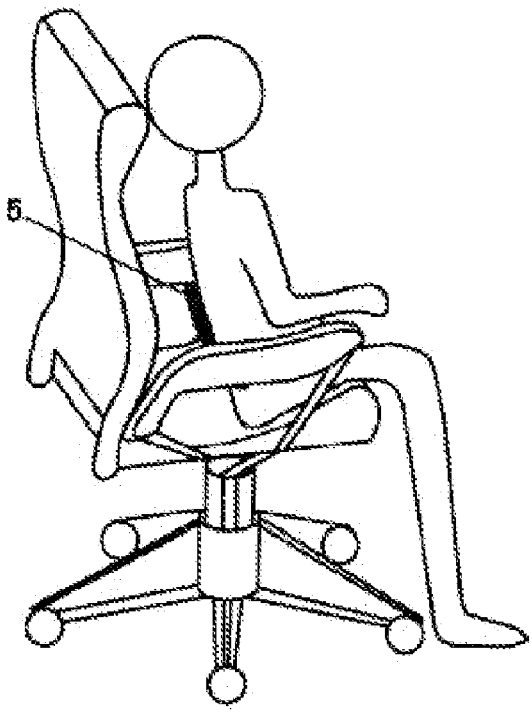
FIG. 2 is a perspective view of a chair in accordance with the present invention being utilized by a person.
Figure 3:
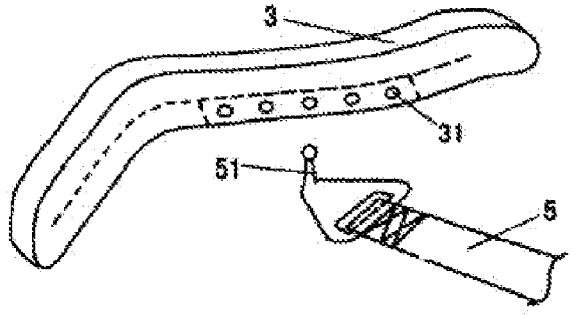
FIG. 3 illustrates an armrest and a support element unconnected to the armrest in accordance with the present invention.
Figure 4:
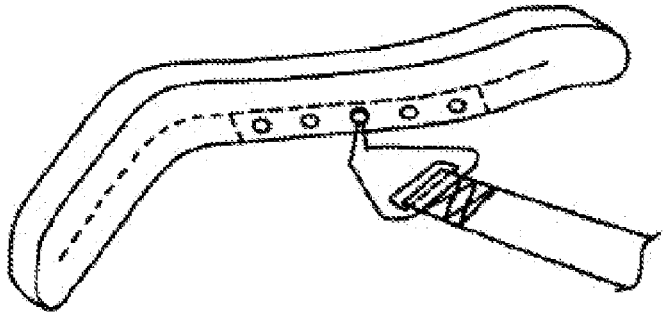
FIG. 4 illustrates an armrest and a support element connected to the armrest in accordance with the present invention.

As shown in FIGS. 1-4, a chair 1 in accordance with the present invention comprises a seat 4, a backrest 2, a pair of armrests 3, a seat support structure 6, and a support element 5. The support element 5 is, e.g., a flexible support element 5 in the shape of strip or band or rope. These characteristics allow it to assume the shape of the lower back of a seated person using said chair. This is to say that the support element wraps around and adjusts to the contours of the lower back of a seated person using said chair in a manner similar to that of a belt worn around a person's waist.

A hook 51 is set at each end of the flexible support element 5. A plurality of cavities 31 is formed at predetermined intervals on the lower portion of each armrest 3. By inserting, and fixing respectively, the hooks 51 at the two ends of the support element into the cavities 31 on the two armrests 3, the support element 5 is positioned behind the lower back, and thereby supports the lower back of a seated person. By adjusting the positions of the hooks 51 on the armrests 3, such as to insert them into cavities that are located in the forward sections of the armrests (i.e., cavities that are closer to the front of the chair), in the midsections of the armrests, or in the back sections of the armrests, the position of the support element 5 can be changed accordingly so as to accurately support the lower back of the seated person in different sitting postures.

As referred to herein, the term "hook" includes any object, such as without limitation, a hook, a projection, a fastener, etc., which inserted into or mechanically-connected to a cavity allows for the forming a secure, yet detachable, connection. Similarly, the term "cavity," as referred to herein, includes any object, such as without limitation, a cavity, a hole, a slot, a protrusion, etc., which can receive a hook so as to form a secure, yet detachable, connection. The "hook" and the "cavity" can be interchanged in position, i.e., the hook can be positioned on the armrest and the cavity can be positioned on the support element. The connection between the supporting element and the armrest can be accomplished in various other ways, e.g., by using pins, safety pins, screws, twist-and-lock mechanisms, swivel hooks, bolt snaps, spring snaps, snap hooks, spring hooks, latch plates and buckles, and many other types of detachable mechanical connectors.

The term "directly," as used herein, and as referring to a mechanical connection means that at least two elements are connected to each other without the assistance of a third element which is not a part of either of the elements being connected. For example, if a support element is directly mechanically-connected to an armrest, this means that the support element is connected to the armrest without the assistance of a third element, such as the back rest or the seat, even though the support element is directly mechanically-connected connected to an armrest by means of a hook and cavity if, e.g., the support element comprises the hook and the armrest comprises the cavity.

The term "elongated," as used herein and as referring to a support element means that the length of such support element is much larger than its width under normal conditions. For example, the ratio of length to width of an elongated element is from about 40:1 to about 5:1, and preferably from about 20:1 to about 10:1. For example, an elongated in shape support element is a belt, a strip, a band or a rope.

As used herein, the term "rope" means a length of strong and stout line or cordage, usually made of twisted strands of hemp, flax, or other fibrous material, but also of strips of hide, pliant twigs, metal wire, etc.

As used herein, the term "belt" means a broadish, flat strip of material, in other contexts used to gird or encircle the person, confine some part of the dress, and to support various articles of use or ornament.

As used herein, the term "strip" means a narrow piece (primarily of textile material, or the like) of approximately uniform breadth.

As used herein, the term "band" means a string, a strap, or a chain. As used herein, the term "string" is meant to include a line, cord, or thread. As used herein, the term "strap" is meant to include a line, a cord, or a thread.

As used herein, the term "chain" means a connected series of links (of material) passing through each other, or otherwise jointed together, so as to move on each other more or less freely, and thus form a strong but flexible ligament or string.

As used herein, and as referring to a support element, the term "flexible" means capable of being bent, admitting of change in figure without breaking; yielding to pressure, pliable, pliant, and not rigid. This property allows the support element to mould to the lower back of a seated person, i.e., to fit closely to the lower back of a seated person so as to provide support. This is not to say, however, that the support element is capable of being longitudinally stretched, dilated, or distorted by external force to a great extent in a direction parallel to its surface without braking, or that it spontaneously resumes its normal bulk or shape after having been contracted, dilated, or distorted by external force.

The support element is made, for example and without limitation, of leather, or plastic, e.g., nylon or polypropylene, or any other suitable material.

The support element 5 is positioned so as to provide the best support for the lower back of a seated person. In certain embodiments, the support element 5 is a knitted ductile strip. Due to its being ductile and stretchable, it will assume its natural length when the chair is not in use (as shown in FIG. 1). When a person sits upright in the chair 1 or leans back, the support element 5 will move backwards, and stretch around the lower back thereby supporting the lower back of the seated person (shown in FIG. 2). When the lower back of the seated person does not need to be supported, the hooks at one or both ends of the support element 5 are detached from the cavities 31 of the armrests so as to stow the support element 5 away. The term "lower back", as used herein, is meant to include all areas of the back of a seated person, including the waist, which can be supported by a support element connected to the armrests.

With reference to FIGS. 3-7, the hook 51 is set at each end of the support element 5. A plurality of concave cavities 31 for receiving and holding the hook 51 are formed on the lower portion of each armrest 3. When in use, the hooks 51 at both ends of the support element are inserted into the cavities 31 of the armrests 3 so as to position the support element behind the lower back of the seated person to provide support in different sitting postures. Sitting postures include without limitation sitting: upright (erect), declined, slightly-declined, reclined, slightly-reclined, deeply-reclined, slouching, bending forward, bending forward slightly, and postures in between these postures.

Figure 5:
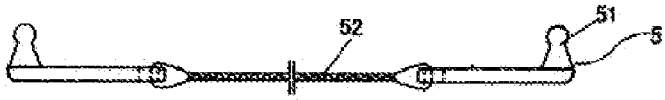
FIG. 5 is a side plan view of a support element in accordance with the present invention.
Figure 6:
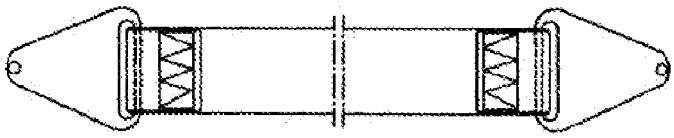
FIG. 6 is a top plan view of a support element in accordance with the present invention.

As shown in FIGS. 5-6, the middle portion of the support element 5 is a ductile strip 52, hook 51 is set at each end of the support element 5, and matched with cavities 31 located in the lower portion of the armrests 3, and can be inserted into the cavities 31 easily for a secure connection.

Figure 7:
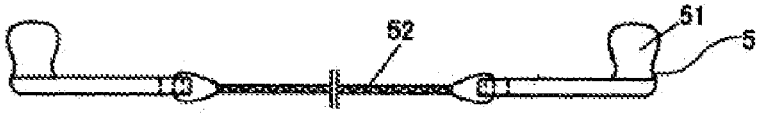
FIG. 7 is a side plan view of another embodiment of a support element in accordance with the present invention.

FIG. 7 illustrates another embodiment of the support element 5 in accordance with the present invention, wherein the hook 51 at each end of the support element 5 is in the shape of a projection, a fastener or a circle-headed fastener, and the like.

Figure 8:
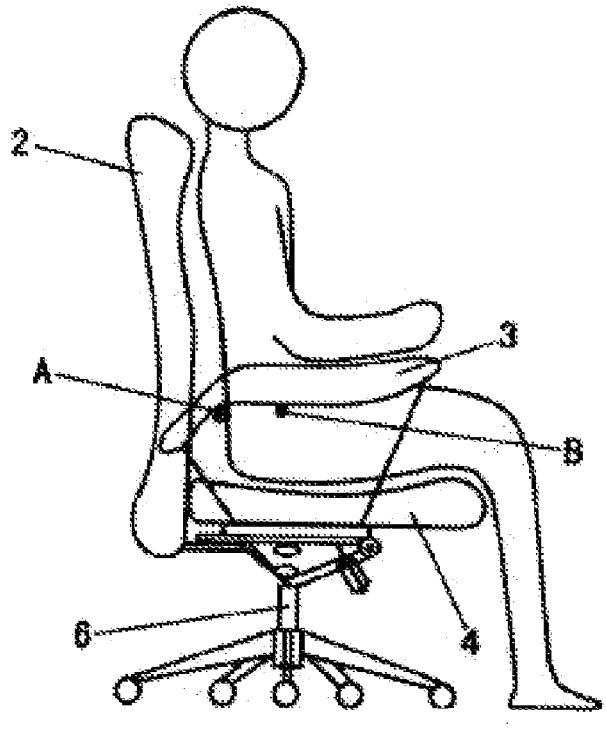
FIG. 8 illustrates a person sitting in an upright position in a chair in accordance with the present invention.
Figure 9:
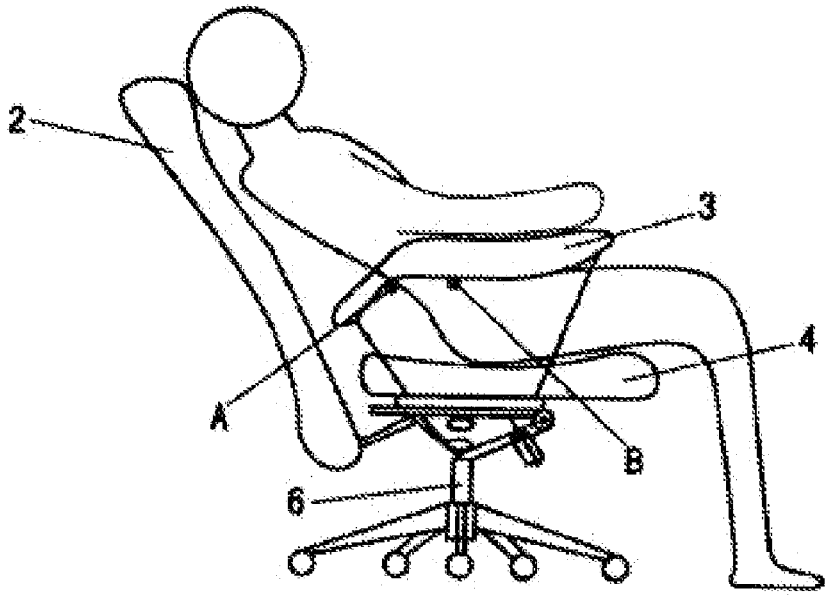
FIG. 9 illustrates a person sitting in a deeply-reclined position in a chair in accordance with the present invention.

With reference to FIGS. 8-9, a chair 1 in accordance with the present invention comprises a seat 4, a backrest 2, a pair of armrests 3, a seat support structure 6 and a support element 5 having two ends and being in the shape of a strip, a band, or a rope, wherein the seat support structure 6 is connected respectively to the backrest 2 and the seat 4, the armrests 3 are fixed connected to the seat 4, the backrest 2 is separated with the seat 4 and the angle therebetween can be changed by adjusting the seat support structure 6, the two ends of the support element 5 are mechanically-connected each to one of the armrests of the chair respectively so as to position the support element behind the lower back of the seated person; and by adjusting the position of the two ends of the support element 5 on the armrests of the chair (for example to point A, or to point B), the support element 5 is positioned to support the lower back of the seated person in different sitting postures.

When the support element is in use, the hooks 51 at the two ends of the support element 5 make contact with cavities 31 disposed in the armrests 3, e.g., at point A. At this point, the support element 5 is relative close to the backrest 2 of the chair, and the support element 5 does not exert a large force to the lower back of the seated person when the chair is in an upright position (shown in FIG. 8). When the person leans back, the backrest 2 of the chair is forced inclined backwards, while the support element 5 fixed to the armrests 3 provides greater resistance to the lower back of the seated person moving backward and provides support to the lower back. Meanwhile, the distance between point A and the backrest of the chair increases and the support element 5 serves to support the lower back of the seated person (a shown in FIG. 9). Similarly, when a person needs a relative larger supporting force, the hooks of the support element 5 can be inserted into the cavities at the front portion of the armrests, e.g., at point B. In this way, when the person leans back, a larger supporting force to the lower back or lower back is applied.

In certain embodiments of the invention, the support element 5 of the present invention is a ductile leather belt or a knitted belt, or the like. In certain embodiments of the invention, the surface of the support element is covered with soft material, such as velvet, satin fabric, plush fabric, velour, etc., so as to improve comfort to the seated person.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

What is claimed is:

1. A chair comprising a seat;

a backrest;

a first armrest;

a second armrest;

a seat support structure; and means for supporting the lower back of a seated person; wherein said means for supporting the lower back of a seated person is directly mechanically-connected to said first armrest and said second armrest;

said means for supporting the lower back of a seated person is not directly mechanically-connected to either said backrest or said seat; and said means for supporting the lower back of a seated person is a flexible support element being of an elongated shape;

said means for supporting the lower back of a seated person is a flexible support element having two ends, one of said ends being connected to said first armrest and the other end being connected to said second armrest;

said flexible support element and said first and said second armrests comprise means for mechanically-connecting said flexible support element to said first and said second armrests; and said means for mechanically-connecting said flexible support element to said first and said second armrests comprises a pair of hooks disposed one at each end of said flexible support element; and a plurality of cavities capable of receiving said hooks disposed in said in first and said second armrests.

2. The chair of claim 1, wherein said first and said second armrests have a longitudinal direction, said plurality of cavities are disposed in said first and said second armrests at various positions along said longitudinal direction, and said hook is inserted into cavities in said first and said second armrests at various positions along said longitudinal direction so as to provide support to the lower back of the seated person in different sitting postures.

3. The chair of claim 2, wherein one said hook is inserted into a first cavity in said first armrest and a second said hook is inserted into a second cavity in said second armrest.

4. The chair of claim 3, wherein the shortest distance from said first cavity to said backrest is not about equal to the shortest distance from said second cavity to said backrest.

5. The chair of claim 1, wherein said flexible support element is covered with a soft material.

6. The chair of claim 1, wherein said flexible support element is made of leather, a knitted material, or a plastic material.

7. A method for supporting the lower back of a seated person in the need of such supporting comprising providing to said person a chair comprising a seat;

a backrest;

a first armrest;

a second armrest;

a seat support structure; and means for supporting the lower back of a seated person; wherein said means for supporting the lower back of a seated person is directly mechanically-connected to said first armrest and said second armrest;

said means for supporting the lower back of a seated person is not directly mechanically-connected to either said backrest or said seat; and said means for supporting the lower back of a seated person is a flexible support element being of an elongated shape;

said means for supporting the lower back of a seated person is a flexible support element having two ends, one of said ends being connected to said first armrest and the other end being connected to said second armrest;

said flexible support element and said first and said second armrests comprise means for mechanically-connecting said flexible support element to said first and said second armrests;

said means for mechanically-connecting said flexible support element to said first and said second armrests comprises a pair of hooks disposed one at each end of said flexible support element; and a plurality of cavities capable of receiving said hooks disposed in said in first and said second armrests.

8. The method of claim 7, wherein the position of said support element can be changed with respect to said first and/or said second armrest.

9. The method of claim 7, wherein said means for supporting the lower back of a seated person is capable of supporting the lower back of a seated person in various sitting postures.

10. The method of claim 7, wherein said first and said second armrests have a longitudinal direction, said plurality of cavities are disposed in said first and said second armrests at various positions along said longitudinal direction, and said hook is inserted into cavities in said in first and said second armrests at various positions along said longitudinal direction so as to provide support to the lower back of the seated person in different sitting postures.

11. The method of claim 7, wherein said flexible support element is covered with a soft material.

12. The method of claim 7, wherein said flexible support element is made of leather, a knitted material, or a plastic material.

13. The chair of claim 1, wherein the position of said support element can be changed with respect to said first and/or said second armrest.

14. The chair of claim 1, wherein said means for supporting the lower back of a seated person is capable of supporting the lower back of a seated person in various sitting postures.

* * * * *